United States Patent [19]

Seyffert et al.

[11] 4,378,283

[45] Mar. 29, 1983

[54] CONSUMABLE-ANODE SELECTIVE PLATING APPARATUS

[75] Inventors: Michael Seyffert, Santa Cruz; Gerald C. Laverty, Santa Clara, both of Calif.

[73] Assignee: National Semiconductor Corporation, Santa Clara, Calif.

[21] Appl. No.: 288,590

[22] Filed: Jul. 30, 1981

[51] Int. Cl.[3] ..... C25D 17/00; C25D 17/10

[52] U.S. Cl. ..... 204/206; 204/224 R

[58] Field of Search ..... 204/206, 224 R

[56] References Cited

U.S. PATENT DOCUMENTS 3,723,283 3/1973 Johnson ..... 204/224 R 4,029,555 6/1977 Tezuka ..... 204/206

4,220,506 9/1980 Skurkiss ..... 204/206

4,224,117 9/1980 Edwards ..... 204/224 R

*Primary Examiner*—T. M. Tufariello

*Attorney, Agent, or Firm*—Neil B. Schulte; Paul J. Winters; Gail W. Woodward

[57] ABSTRACT

A consumable-anode selective plating apparatus for plating a continuous metal strip having a container for containing a consumable anode material, a mask assembly for exposing selected areas of said continuous metal strip to an electrolyte, a source of electrolyte and a source of power and conductors for passing a current through said electrolyte, consumable anode material and metal strip.

4 Claims, 2 Drawing Figures

CONSUMABLE-ANODE SELECTIVE PLATING APPARATUS

BACKGROUND OF THE INVENTION

1. Field of the Invention

The present invention relates to plating apparatus in general and in particular to electrolytic plating apparatus for plating selected areas on a continuous metal strip.

2. Description of the Prior Art

Typical of continuous metal strips which are plated using the present invention is a lead frame used in the fabrication of integrated circuit packages.

Selected areas of an integrated circuit package lead frame are plated to obtain certain electrical and mechanical properties. For example, the exposed leads of semiconductor packages are plated with a tin-lead solder to protect the exposed leads from corrosion and to improve the electrical properties of subsequent connections to the leads. Heretofore it was common practice to individually dip the leads of semiconductor packages into a pool of molten solder to coat the leads with solder. However, this solder dipping technique is slow and places an undesirably thick layer of solder, often as thick as 1 mil, on the package leads. This thickness is much greater than is necessary for bonding and corrosion resistance and is often not as uniform as is desirable. The heat from the molten solder also may cause failure of an integrated circuit within the package or the bond between the metal leads and a plastic enclosure which encapsulates the integrated circuit.

The die receiving pad of a lead frame is typically spot plated with a precious metal. Spot plating is another type of selective plating. In spot plating apparatus, the anode typically comprises a pair of wires immersed in an electrolytic plating bath containing plating material. The bath fluid is forced through relatively small jets against the surface of the die pad. While uniform and controlled depositions can be obtained using a spot plating technique, the selective plating of larger areas using conventional spot plating techniques results in unstable electrolytic baths which must be constantly replenished with plating material and is therefore time consuming and costly.

SUMMARY OF THE INVENTION

In view of the foregoing, a principal object of the present invention is a consumable anode selective plating method and apparatus.

In accordance with the above object, there is provided in combination a means for containing a consumable anode, means for exposing a selected area on the surface of a lead frame, means for providing an electrolyte between the consumable anode and the exposed area of the lead frame, and means for passing a current through the electrolyte between the consumable anode and the lead frame.

In an alternative embodiment of the present invention, identical plating apparatus is employed for simultaneously plating both sides of a lead frame.

In the apparatus described above, the means used for exposing a selected area on the surface of the lead frame comprises a dual-walled masking apparatus comprising a pair of spaced walls. In one of the walls, adjacent to the lead frame there is provided one or more apertures for exposing a corresponding number of selected areas of the lead frame. In the other wall there is provided a plurality of apertures for permitting a flow of electrolytic fluid between the consumable anode material and the lead frame.

In practice, electrolytic fluid is caused to flow between the walls of the dual-walled masking apparatus. When the electrolytic fluid reaches the apertures in the walls, the fluid flows laterally through the apertures of the lead frame and through the consumable anode material. To ensure a uniform plating on the selected areas of the lead frame, means are also provided for creating turbulence in the vicinity of the lead frame, as by a pointed baffle member.

As the electrolytic fluid is discharged from between the walls of the masking apparatus and the consumable anode material, it flows into a sump for recirculation through the apparatus.

In systems employing two of the above described masking apparatuses for simultaneously plating opposite sides of the lead frame, there is also provided means for adjusting the position of one of the masking apparatuses relative to the other for purposes of controlling the relative position of the plating on the opposite sides of the lead frame.

By using the present invention, it is found that continuous large area selective plating over long periods of time can be done without undesirable depletion of the plating bath and with excellent plating results.

BRIEF DESCRIPTION OF THE DRAWING

The above and other objects, features and advantages of the present invention will become apparent in the following detailed description of the accompanying drawing in which.

DETAILED DESCRIPTION OF THE PREFERRED EMBODIMENT

Figure 1:
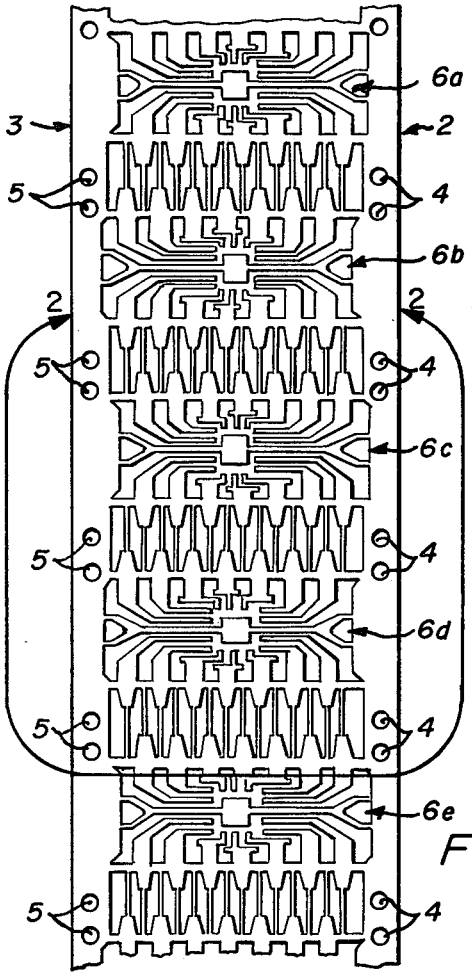
FIG. 1 is a portion of a continuous metal strip lead frame comprising a plurality of 14-pin lead frame patterns used in the fabrication of semiconductor packages.

Referring to FIG. 1, there is shown a portion of a continuous lead frame designated generally as 1. In the lead frame 1 there is provided along its lateral edges a pair of indexing rails 2 and 3. In the indexing rails 2 and 3 there is provided a plurality of indexing holes 4 and 5, respectively. Between the rails 2 and 3 there is provided a plurality of 14-pin lead frame patterns, *6a, 6b, 6c, 6d, 6e*, etc. It is understood that the 14-pin lead frame patterns shown are merely illustrative of typical lead frame patterns and that other lead frame patterns with more or less leads are used in making semiconductor packages. For convenience, an enlarged view of lead frame patterns *6c* and *6d* are shown in FIG. 2.

Figure 2:
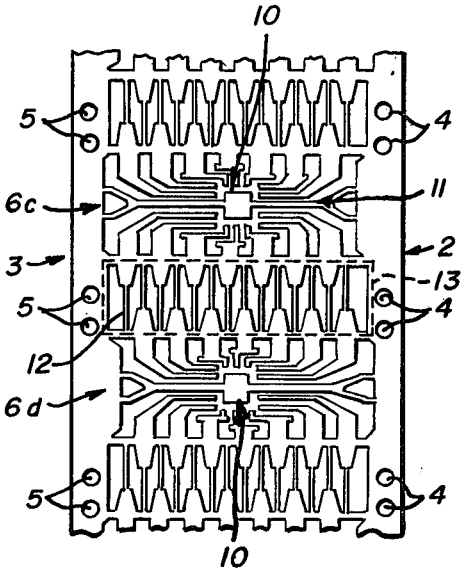
FIG. 2 is an enlarged view of two of the 14-pin lead frame patterns of FIG. 1.

Referring to FIG. 2, there is provided in each of the lead frame patterns *6c* and *6d* a semiconductor chip receiving pad 10. Extending from the pad 10 there is provided a plurality of 14 inner leads 11. Extending outwardly from the inner leads 11 there is provided a plurality of 14 outer leads 12. The leads 11 and 12 are divided, with seven being on one side of the associated die receiving pad 10 and seven being on the opposite side of the die receiving pad 10.

In accordance with the present invention, the outer lead 12 of two adjacent lead patterns, which are interdigitated, are plated with a tin-lead alloy within the area bounded by the broken lines designated generally as 13.

Referring to FIGS. 3, 3A, 4, and 5, there is provided a generally rectangular box-shaped consumable anode selective plating apparatus according to the present invention designated generally as 20 comprising an open top, box-shaped housing 7. In the apparatus 20 there is provided a pair of dual-wall mask assemblies 21 and 22 movably mounted in the open top, box-shaped housing 7. Within the mask assemblies 21 and 22, there is provided a pair of walled containers 23 and 24. In the containers 23 and 24 there is provided a plurality of support member 63. Containers 23 and 24 are provided for containing a consumable anode material 18. Inside of the containers 23 and 24, there is provided a pair of permanent anode members 25 and 26 for making electrical contact with the consumable anode material. Typically, members 25 and 26 comprise generally rectangular plate-like members and are connected to the positive terminal of a suitable power supply in a conventional manner (not shown). The support members 63 provide proper spacing and provide pressure resistance when mask assemblies 21 and 22 are closed on the lead frame 1. Outside of the containers 23 and 24, there is provided a pair of electrolytic fluid passageways 27 and 28, respectively. In the passageways 27 and 28 there is provided a plurality of support member 64. Members 64 provide proper spacing for the mask assemblies 21 and 22 and pressure resistance when the mask assemblies are closed on the lead frame.

Electrolyte 8 from a sump 9 enters the apparatus from a pair of electrolytic fluid input pipes 29 and 30. From the pipes 29 and 30, the fluid passes through a manifold 65 and a plurality of input ports 66 through the apparatus to the passageways 27 and 28. The electrolyt 8 from the passageways 27 and 28 is then discharged through a plurality of discharge ports 67, a manifold 68 and a pair of pipes 31 and 32 and recirculated through the apparatus by means of a pair of pumps 33 and 34 respectively. As will be described in further detail below, the lead frame 1 during plating is clamped between the mask assemblies 21 and 22.

Each of the mask assemblies 21 and 22 are identical and, accordingly, only mask assembly 21 will be described in detail below with respect to FIGS. 4 and 5.

Figure 4:
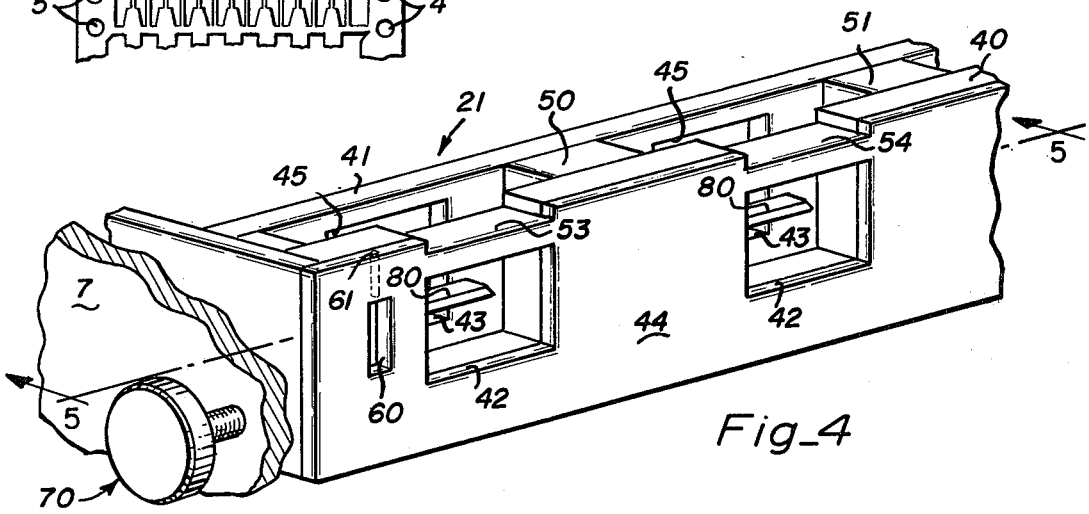
FIG. 4 is a isometric view of one of the masks of the apparatus of FIG. 3.
Figure 5:
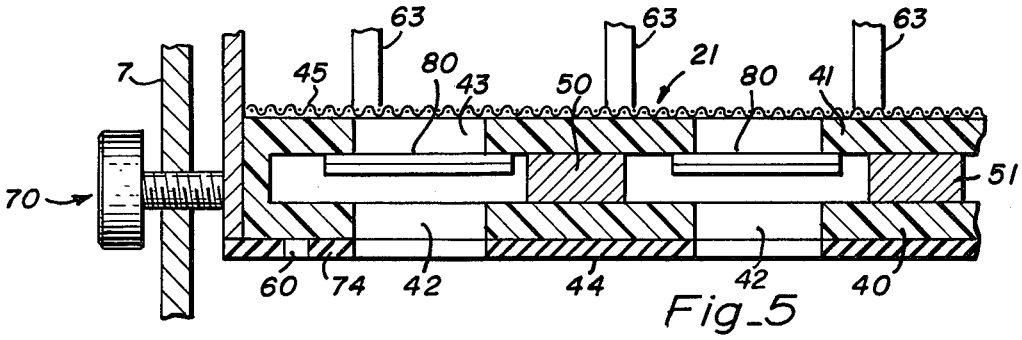
FIG. 5 is a cross-sectional view taken along the lines 5—5 of FIG. 4.

Referring to FIGS. 4 and 5, there is provided in the mask assemblies 21 and 22 a pair of wall members 40 and 41. Wall members 40 and 41 are provided with a plurality of windows 42 and 43 respectively. On the exterior surface of the wall member 40 and surrounding the windows 42, there is provided a resilient sealing material 44. The material 44 is provided for sealing the mask assembly 21 against the lead frame 1 in a fluid-tight fashion for preventing an excursion or migration of electrolytic fluid between the mask 21 and the lead frame 1 during plating of the lead frame.

Over the windows 43 there is provided screening material 45. Screening material 45 is provided for containing the consumable anode material 18 in containers 23 and 24 and in intimate electrical contact with the permanent anodes 25 and 26, described above with respect to FIGS. 3 and 3A.

Wall members 40 and 41 are separated by a plurality of resilient members 50 and 51. Members 50 and 51 are provided for permitting the wall members 40 and 41 to flex inwardly and outwardly and thereby ensure a good fluid-tight seal between the sealing surface of the material 44 and the surface of the lead frame 1.

Along the upper edge of the wall 40 there is provided a plurality of indexing members in the form of cut outs 53 and 54. Indexing members 53 and 54 provide to the operator a visual indication of the position of the mask assembly 21 relative to an adjacent lead frame 1 when the assembly is inserted in the plating apparatus.

In opposite ends of the wall 40 there is provided in the sealing sheet material 44 a slot 60. Extending from the slot 60 there is provided a fluid pressure relief port 61. The slot 60 and the relief port 61 are provided to permit the material 44 to be squeezed during the fluid-tight sealing of the material 44 against the lead frame 1 without a corresponding distortion of the material about the periphery of the adjacent window 42.

At opposite ends of the mask assembly 21 there is provided an adjusting screw 70 movably mounted in a wall of the housing 7. Adjusting screw 70 is provided for adjusting the position of the mask assembly 21 relative to the housing 7 and relative to the mask assembly 22 when the mask assemblies 21 and 22 are inserted in the housing 7. This adjustment, as will be apparent, is facilitated by the indexing members 53 and 54.

Located across each of the windows 43 and extending approximately halfway into the space between the wall members 40 and 41, there is provided a baffle member 80. As to see more clearly in FIG. 3, baffle member 80 has a generally rectangular cross section with a pointed interior end.

Referring again to FIGS. 3 and 3A, mask assembly 22 and its associated parts are movably mounted on a movable assembly designated generally as 90. The assembly 90 is provided with a pivoting hinge assembly 91. The pivoting hinge assembly 91, or a functionally equivalent assembly, such as a slide, is provided for moving the mask assembly 22 from the lead frame 1 and the mask assembly 21 for indexing the lead frame 1 therebetween. Indexing of the lead frame 1 between the mask assemblies 21 and 22 is required for plating succeeding ones of the lead frame patterns *6a, 6b,* etc.

In operation, the lead frame 1 is positioned between mask assemblies 21 and 22. With the lead frame 1 positioned between the mask assemblies 21 and 22, mask assembly 22 is moved into a fluid-tight fit against the lead frame 1. After the mask assemblies 21 and 22 are positioned and form a fluid-tight seal with the lead frame 1, power is applied to the permanent anodes 25 and 26. During this time electrolytic fluid is continuously pumped through the pipes 29 and 30. The negative terminal of the power supply is connected to the lead frame in a conventional manner. As the fluid is discharged from the interior end of the pipes 29 and 30, it flows upwardly between the walls 40 and 41 of the mask assemblies 21 and 22 respectively. As the fluid encounters the baffles 80, turbulence is generated, causing the fluid to be diverted through the windows 42 and 43.

As soon as the area of the lead frame exposed by the windows 42 and the consumable anode material 18 is wetted by the electrolytic fluid 8, the plating process begins, with ions of the consumable anode material 18 being dissolved and ions already in solution being deposited on the exposed surface of the lead frame 1.

With a continuous flow of electrolytic fluid 8 between the walls 40 and 41 and through the consumable anode material 18, excess fluid overflows the interior walls of the electrolytic fluid sumps 27 and 28 and returns to the pumping members 33 and 34 through the discharge pipes 31 and 32, respectively.

After a predetermined time determined by the required thickness of the plating material on the lead frame 1, electrical power is turned off and the mask assembly 22 and associated parts are pivoted away from the mask assembly 21 and the lead frame 1 about the axis of the hinge assembly 91. When sufficient clearance is provided therefore, the lead frame 1 is moved for plating another set of the lead frame patterns *6a, 6b,* etc. Thereafter the mask assembly 22 and associated parts are again moved into fluid-tight sealing arrangement with the lead frame 1 and the above-described plating process is repeated.

At suitable times during the plating process measurements are made to determine the accuracy of the location of the plating material on the lead frame 1 and, if necessary, the mask 21 or 22 is adjusted by means of the adjusting screw 70 to reposition the area of the plating on the lead frame. Also, from time-to-time, additional anode material 18, called shot, is added to the containers 23 and 24 to replenish the material consumed.

Figure 3:
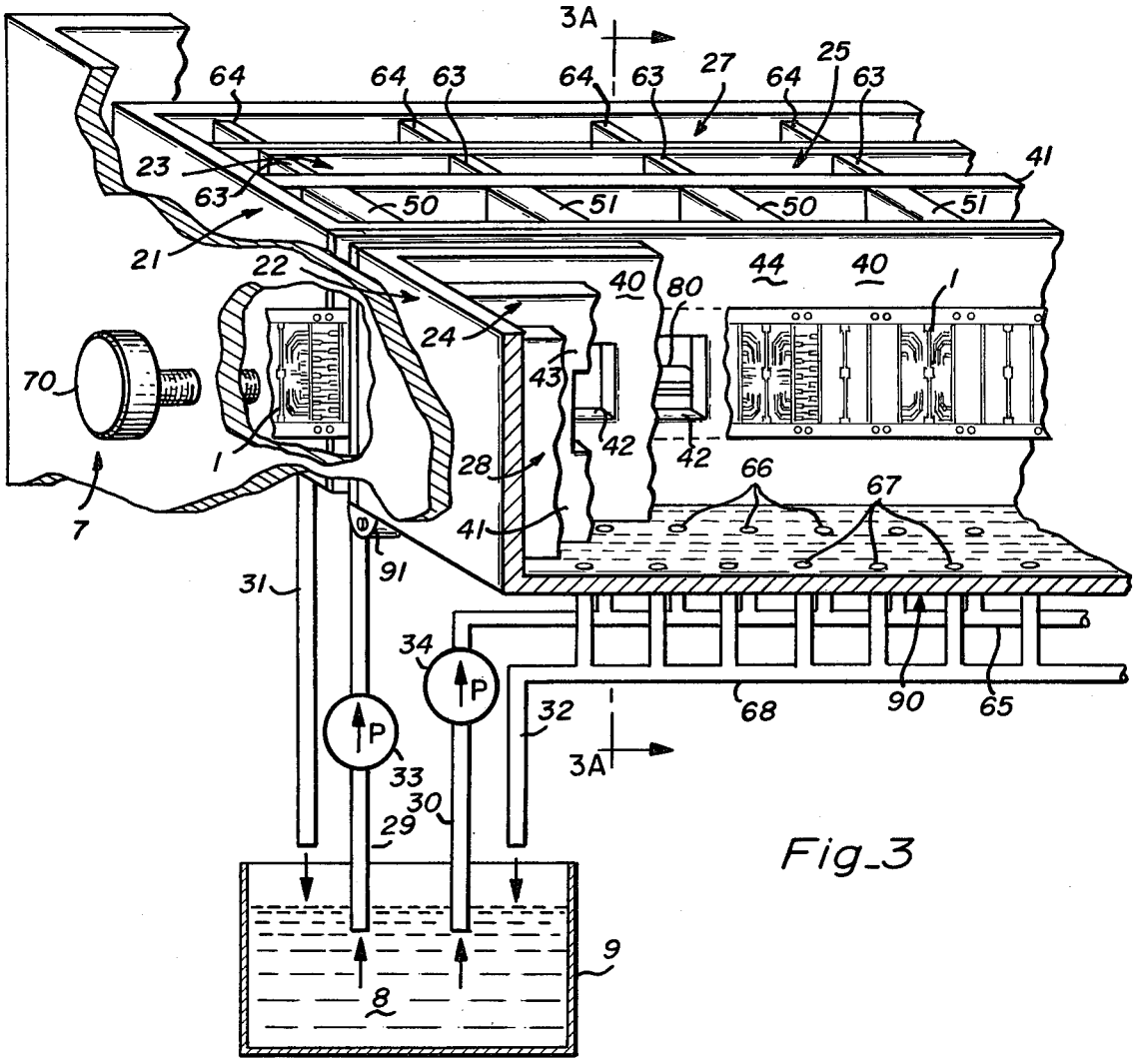
FIG. 3 is an isometric view of a dual mask consumable anode selective plating apparatus according to the present invention.
Figure 3A:
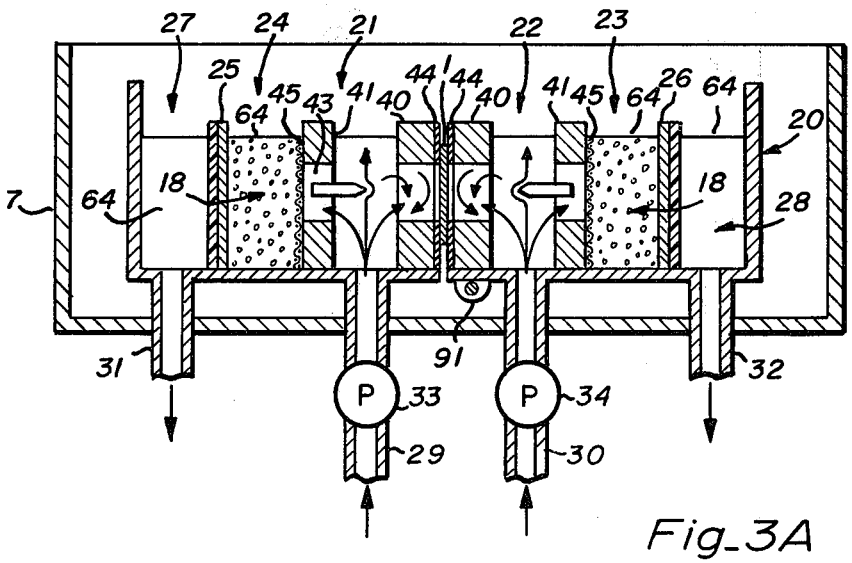
FIG. 3A is a cross-sectional view taken along lines 3A—3A of FIG. 3.

While a preferred embodiment of the invention is described, it is understood that various modifications and changes may be made thereto without departing from the spirit and scope of the present invention. For example, while a lead frame with a single series of 14-pin lead patterns is disclosed and described, it is understood that dual lead frames with 14-pin lead patterns positioned side by side, so as to form a lead frame twice the width of the one shown, may be plated using the apparatus described suitably modified to accommodate the dual lead frame strip. In such a case the mask assemblies 21 and 22 are provided with two rows of windows, one above the other, instead of the single row of windows in walls 40 and 41, as shown in FIGS. 3–5. In addition to increasing the number of areas that can be plated simultaneously on one side of a single or dual lead frame, it is also contemplated that the size of the selected areas may be changed to accommodate a particular application and that the areas may differ in size relative to each other. Also, the plating system can plate any metal strip and use other plating material and is not limited to lead frame or to tin lead plating material. It is also contemplated that while a tin-lead alloy is described as the plating material with which the invention is presently used, that other types of consumable anode materials may be used and in those cases, there will necessarily be employed compatible electrolytic fluids and permanent anodes 25 and 26. Because still other modifications and changes to the embodiments described will occur to those skilled in the art, it is intended that the scope of the invention not be limited to the embodiment described and suggested, but rather be determined by the claims hereinafter provided and their equivalents.

What is claimed is:

1. A plating apparatus for plating the surface of a metal strip comprising:

at least one mask assembly operable to move into sealing relationship with said metal strip;

a masking means, on said assembly, adapted to contact and protect the surface of said strip from plating except in certain selected areas where apertures in the masking means leave the areas exposed;

an electrolyte chamber, on said assembly, proximate the apertures in said masking means so as to convey electrolyte into said apertures;

container means, on said assembly, adapted to contain a consumable anode material, and having passageways communicating with the electrolyte chamber and the apertures in the masking means, said container means including a generally permanent anode in contact with said consumable anode material; and electrolyte pumping means to circulate electrolyte from a reservoir to said chamber so as to supply a flow of electrolyte to the apertures and the container means, the electrolyte from said chamber and said container flowing back to said reservoir.

2. The apparatus of claim 1 including baffle means in said chamber positioned to divert and induce turbulence in the electrolyte to enhance the flow of electrolyte to said apertures and said container.

3. The apparatus of claim 1 in which said chamber, apertures, and passageways are aligned and configured to provide a low resistance electrical current path from said consumable anode material to said exposed areas.

4. The apparatus of claim 3 including baffle means in said chamber positioned to divert and induce turbulence in the electrolyte to enhance the flow of electrolyte to said apertures and said container.

* * * * *